US009534599B2

(12) United States Patent
Rosson et al.

(10) Patent No.: US 9,534,599 B2
(45) **Date of Patent: *Jan. 3, 2017**

(54) SCROLL COMPRESSOR HAVING A FIRST AND SECOND OLDHAM COUPLINGS

(71) Applicant: DANFOSS COMMERCIAL COMPRESSORS, Reyrieux, Trevoux (FR)

(72) Inventors: Yves Rosson, Villars les Dombes (FR); Patrice Bonnefoi, Saint Didier au Mont d'Or (FR); Ingrid Claudin, Villars les Dombes (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 278 days.

This patent is subject to a terminal disclaimer.

(21) Appl. No.: 14/138,258

(22) Filed: Dec. 23, 2013

(65) Prior Publication Data

US 2014/0178228 A1 Jun. 26, 2014

(30) Foreign Application Priority Data

Dec. 21, 2012 (FR) ..... 12 62568

(51) Int. Cl.
*F04C 29/00* (2006.01)
*F04C 18/02* (2006.01)

(52) U.S. Cl.
CPC ..... *F04C 29/0057* (2013.01); *F04C 18/0207* (2013.01); *F04C 18/0215* (2013.01); *F04C 29/0021* (2013.01)

(58) Field of Classification Search
CPC .. F04C 18/0207; F04C 18/023; F04C 18/0238
See application file for complete search history.

(56) References Cited

U.S. PATENT DOCUMENTS 5,141,421 A 8/1992 Bush et al.
5,775,893 A * 7/1998 Takao ..... F04C 29/0021 418/55.3

(Continued)

FOREIGN PATENT DOCUMENTS

EP 1 830 067 A1 9/2007

OTHER PUBLICATIONS

Preliminary Search Report issued in French Patent Application No. 1262567 dated Sep. 5, 2013 (with translation).

*Primary Examiner* — Mary A Davis
(74) *Attorney, Agent, or Firm* — Oliff PLC

(57) ABSTRACT

This scroll compressor includes first and second fixed scroll members, first and second orbiting scroll members, a first Oldham coupling provided between the first orbiting scroll member and the first fixed scroll member and configured to prevent rotation of the first orbiting scroll member with respect to the first fixed scroll member, and a second Oldham coupling provided between the second orbiting scroll member and the second fixed scroll member and configured to prevent rotation of the second orbiting scroll member with respect to the second fixed scroll member. The first Oldham coupling is slidably mounted with respect to the first fixed scroll member along a first displacement direction, and the second Oldham coupling is slidably mounted with respect to the second fixed scroll member along a second displacement direction parallel with respect to first displacement direction. First and second orbiting scroll members are configured to operate in phase opposition.

13 Claims, 3 Drawing Sheets

(56) References Cited

U.S. PATENT DOCUMENTS

| | | | | |
|---|---|---|---|---|
| 9,169,841 | B2 * | 10/2015 | Bonnefoi | F04C 29/0021 |
| 2003/0194340 | A1 | 10/2003 | Ni | |
| 2009/0022613 | A1 * | 1/2009 | Dai | F04C 18/0269<br>418/55.2 |
| 2011/0300013 | A1 * | 12/2011 | Hwang | F04C 29/0057<br>418/55.3 |

* cited by examiner

SCROLL COMPRESSOR HAVING A FIRST AND SECOND OLDHAM COUPLINGS

FIELD OF THE INVENTION

The present invention relates to a scroll compressor, and in particular to a scroll refrigeration compressor.

BACKGROUND OF THE INVENTION

As known, a scroll compressor comprises:

- a fixed scroll member comprising a fixed end plate and a fixed spiral wrap provided on one face of the fixed end plate,
- an orbiting scroll member comprising an orbiting end plate and an orbiting spiral wrap provided on one face of the orbiting end plate, the fixed spiral wrap and the orbiting spiral wrap forming a plurality of compression chambers,
- a support frame, also named crankcase, on which is slidably mounted the orbiting end plate of the orbiting scroll member,
- an Oldham coupling provided between the orbiting scroll member and the support frame, and configured to prevent rotation of the orbiting scroll member with respect to the support frame, the Oldham coupling being slidably mounted with respect to the support frame along a first displacement direction,
- a drive shaft adapted for driving the orbiting scroll member in an orbital movement, and
- an electric motor for driving in rotation the drive shaft about a rotation axis.

In order to reduce the compressor vibrations generated by the reciprocating translation movement of the Oldham coupling along the first displacement direction and by the orbital movement of the orbiting scroll member, the scroll compressor further comprises a rotating counterweight attached to the drive shaft.

However, the unbalance induced by the reciprocating translation movement of the Oldham coupling and by the orbital movement of the orbiting scroll member cannot be perfectly compensated thanks to a rotating counterweight, which leads to a residual unbalance, and thus to residual compressor vibrations. Such residual compressor vibrations may cause a damage of some parts of the scroll compressor, and may detract the efficiency of the scroll compressor.

Further the efficiency of the scroll compressor may also be detracted due to the high mass of the counterweight needed to balance the compressor.

SUMMARY OF THE INVENTION

It is an object of the present invention to provide an improved scroll compressor which can overcome the drawbacks encountered in conventional scroll compressors.

Another object of the present invention is to provide a scroll compressor which is reliable and which can be easily balanced.

According to the invention such a scroll compressor comprises:

- a first fixed scroll member comprising a first fixed end plate and a first fixed spiral wrap provided on one face of the first fixed end plate,
- a first orbiting scroll member comprising a first orbiting end plate and a first orbiting spiral wrap provided on one face of the first orbiting end plate, the first fixed spiral wrap and the first orbiting spiral wrap forming a plurality of compression chambers,
- a second fixed scroll member comprising a second fixed end plate and a second fixed spiral wrap provided on one face of the second fixed end plate,
- a second orbiting scroll member comprising a second orbiting end plate and a second orbiting spiral wrap provided on one face of the second orbiting end plate, the second fixed spiral wrap and the second orbiting spiral wrap forming a plurality of compression chambers, and wherein the first and second orbiting scroll members are configured to operate in phase opposition, that is to orbit in phase opposition.

Due to the operation in phase opposition of the first and second orbiting scroll members, the inertia force induced by the orbiting movement of the first orbiting scroll member is at least partially compensated by the inertia force induced by the orbiting movement of the second orbiting scroll member.

Therefore, the mass of the counterweight needed to balance the compressor can be reduced, which leads on the one hand to a reduction of the mass of the compressor and thus to an improvement of the compressor efficiency, and on the other hand to a simplification of the assembly of the latter.

Further, such a partial compensation of the inertia force induced by the orbiting movement of the first orbiting scroll member by the inertia force induced by the orbiting movement of the second orbiting scroll member allows to ease the balancing of the compressor.

According to an embodiment of the invention, the scroll compressor further comprises:

- a first Oldham coupling provided between the first orbiting scroll member and the first fixed scroll member, and configured to prevent rotation of the first orbiting scroll member with respect to the first fixed scroll member, the first Oldham coupling being slidably mounted with respect to the first fixed scroll member along a first displacement direction,
- a second Oldham coupling provided between the second orbiting scroll member and the second fixed scroll member, and configured to prevent rotation of the second orbiting scroll member with respect to the second fixed scroll member, the second Oldham coupling being slidably mounted with respect to the second fixed scroll member along a second displacement direction, wherein the first and second displacement directions of the first and second Oldham couplings are substantially parallel with respect to each other.

Due to the parallel movements of the first and second Oldham couplings, the unbalance induced by the reciprocating movement of the first Oldham coupling is at least partially compensated by the unbalance induced by the reciprocating movement of the second Oldham coupling, which allows to ease the balancing of the compressor and thus to greatly reduce the compressor vibrations.

Such a limitation of the compressor vibrations leads to an improvement of the compressor reliability and efficiency.

According to an embodiment of the invention, the first and second Oldham couplings are configured such that, in operation, they undergo reciprocating (or alternate) translation movements respectively along the first and second displacement directions.

According to an embodiment of the invention, the orbital diameter of the first orbiting scroll member is substantially equal to the orbital diameter of the second orbiting scroll member.

According to an embodiment of the invention, the orbital centers of the first and second orbiting scroll members are offset from each other by a predetermined distance substantially equal to the orbital diameters of the first and second orbiting scroll members.

According to an embodiment of the invention, the scroll compressor further comprises a drive shaft adapted for driving the first and second orbiting scroll members in orbital movements, the drive shaft having a rotation axis. In other words, the drive shaft is capable of being driven in rotation about the rotation axis. For example, the scroll compressor further comprises a motor for driving in rotation the drive shaft about the rotation axis.

According to an embodiment of the invention, the orbital centers of the first and second orbiting scroll members are equally distant from the rotation axis of the drive shaft.

According to an embodiment of the invention, the first and second Oldham couplings are configured such that, in operation, the centers of gravity of the first and second Oldham couplings are constantly symmetrically located with respect to the rotation axis of the drive shaft. As a result of this configuration of the first and second Oldham couplings, the inertia forces (and thus the unbalances) induced respectively by the reciprocating translation movements of the first and second Oldham couplings cancel each other. Consequently, said configuration of the first and second Oldham couplings avoids the use of a rotating counterweight for balancing the reciprocating translation movements of the first and second Oldham couplings, which allows to further ease the compressor balancing and the compressor assembly, and also to reduce the mass of the compressor. Moreover, such a cancellation of the unbalances induced by the reciprocating translation movements of the first and second Oldham couplings greatly limits the compressor vibrations.

Further, the first and second Oldham couplings are configured such that the middle-stroke positions of the centers of gravity of the first and second Oldham couplings are substantially equally distant from the rotation axis of the drive shaft.

According to an embodiment of the invention, the first and second displacement directions are substantially perpendicular to the rotation axis of the drive shaft.

According to an embodiment of the invention, the stroke length of the first Oldham coupling along the first displacement direction is substantially equal to the stroke length of the second Oldham coupling along the second displacement direction.

According to an embodiment of the invention, the first and second Oldham couplings respectively include first and second annular bodies that are substantially parallel to each other.

According to an embodiment of the invention, the first Oldham coupling includes:

a first annular body, a first pair of first engaging projections provided on a first side of the first annular body, the first engaging projections of the first Oldham coupling being slidably engaged in a first pair of first guiding grooves provided on the first fixed scroll member, said first guiding grooves being offset and extending substantially parallel to the first displacement direction, and a second pair of second engaging projections provided on a second side of the first annular body, the second engaging projections of the first Oldham coupling being slidably engaged in a second pair of second guiding grooves provided on the first orbiting scroll member, said second guiding grooves being offset and extending substantially perpendicularly to the first displacement direction.

According to an embodiment of the invention, the first annular body is disposed around the first fixed spiral wrap and the first orbiting spiral wrap.

According to an embodiment of the invention, the first engaging projections of the first Oldham coupling extend substantially perpendicularly from the first side of the first annular body and the second engaging projections of the first Oldham coupling extend substantially perpendicularly from the second side of the first annular body.

According to another embodiment of the invention, the first pair of first engaging projections may be provided on the first fixed scroll member, and the first pair of first guiding grooves may be provided on the first side of the first annular body.

According to another embodiment of the invention, the second pair of second engaging projections may be provided on the first orbiting scroll member, and the second pair of second guiding grooves may be provided on the second side of the first annular body.

Thus, for example, the first annular body may comprise the first pair of guiding grooves on its first side and the second pair of second guiding grooves on its second side. The first annular body may also comprise a pair of engaging projections on one of its first and second sides and a pair of guiding grooves on its other side.

According to an embodiment of the invention, the second Oldham coupling includes:

a second annular body, a first pair of first engaging projections provided on a first side of the second annular body, the first engaging projections of the second Oldham coupling being slidably engaged in a first pair of first guiding grooves provided on the second fixed scroll member, said first guiding grooves being offset and extending substantially parallel to the second displacement direction, and a second pair of second engaging projections provided on a second side of the second annular body, the second engaging projections of the second Oldham coupling being slidably engaged in a second pair of second guiding grooves provided on the second orbiting scroll member, said second guiding grooves being offset and extending substantially perpendicularly to the second displacement direction.

According to an embodiment of the invention, the second annular body is disposed around the second fixed spiral wrap and the second orbiting spiral wrap.

According to an embodiment of the invention, the first engaging projections of the second Oldham coupling extend substantially perpendicularly from the first side of the second annular body and the second engaging projections of the second Oldham coupling extend substantially perpendicularly from the second side of the second annular body.

According to another embodiment of the invention, the first pair of first engaging projections may be provided on the second fixed scroll member, and the first pair of first guiding grooves may be provided on the first side of the second annular body.

According to another embodiment of the invention, the second pair of second engaging projections may be provided on the second orbiting scroll member, and the second pair of second guiding grooves may be provided on the second side of the second annular body.

Thus, for example, the second annular body may comprise the first pair of guiding grooves on its first side and the second pair of second guiding grooves on its second side. The second annular body may also comprise a pair of engaging projections on one of its first and second sides and a pair of guiding grooves on its other side.

According to an embodiment of the invention, the first orbiting spiral wrap projects in a first projection direction, and the second orbiting spiral wrap projects in a second projection direction opposite to the first projection direction.

According to an embodiment of the invention, the first orbiting end plate includes a first face on which is provided the first orbiting spiral wrap, and a second face opposite to the first face of the first orbiting end plate, and the second orbiting end plate includes a first face on which is provided the second orbiting spiral wrap, and a second face opposite to the first face of the second orbiting end plate, the second faces of the first and second orbiting end plates facing each other.

According to an embodiment of the invention, the first fixed end plate is supported by the second fixed end plate According to an embodiment of the invention, the second face of the first orbiting end plate is in slidable contact with the second face of the second orbiting end plate.

The present invention also relates to a method of operating a scroll compressor, comprising the steps of:

providing the scroll compressor with:

a first fixed scroll member comprising a first fixed end plate and a first fixed spiral wrap provided on one face of the first fixed end plate, a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a second fixed scroll member comprising a second fixed end plate and a second fixed spiral wrap provided on one face of the second fixed end plate, and a second orbiting scroll member comprising a second orbiting end plate and a second orbiting spiral wrap provided on one face of the second orbiting end plate, the second fixed spiral wrap and the second orbiting spiral wrap forming a plurality of second compression chambers, and displacing the first and second orbiting scroll members respectively along first and second orbital movements in phase opposition so that the inertia force induced by the orbiting movement of the first orbiting scroll member is at least partially compensated by the inertia force induced by the orbiting movement of the second orbiting scroll member.

According to an embodiment of the invention, the providing step further comprises providing the scroll compressor with:

a first Oldham coupling provided between the first orbiting scroll member and the first fixed scroll member, and configured to prevent rotation of the first orbiting scroll member with respect to the first fixed scroll member, the first Oldham coupling being slidably mounted with respect to the first fixed scroll member along a first displacement direction, a second Oldham coupling provided between the second orbiting scroll member and the second fixed scroll member, and configured to prevent rotation of the second orbiting scroll member with respect to the second fixed scroll member, the second Oldham coupling being slidably mounted with respect to the second fixed scroll member along a second displacement direction, wherein the first and second displacement directions of the first and second Oldham couplings are substantially parallel with respect to each other.

These and other advantages will become apparent upon reading the following description in view of the drawing attached hereto representing, as non-limiting example, one embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION OF THE INVENTION

Figure 1:
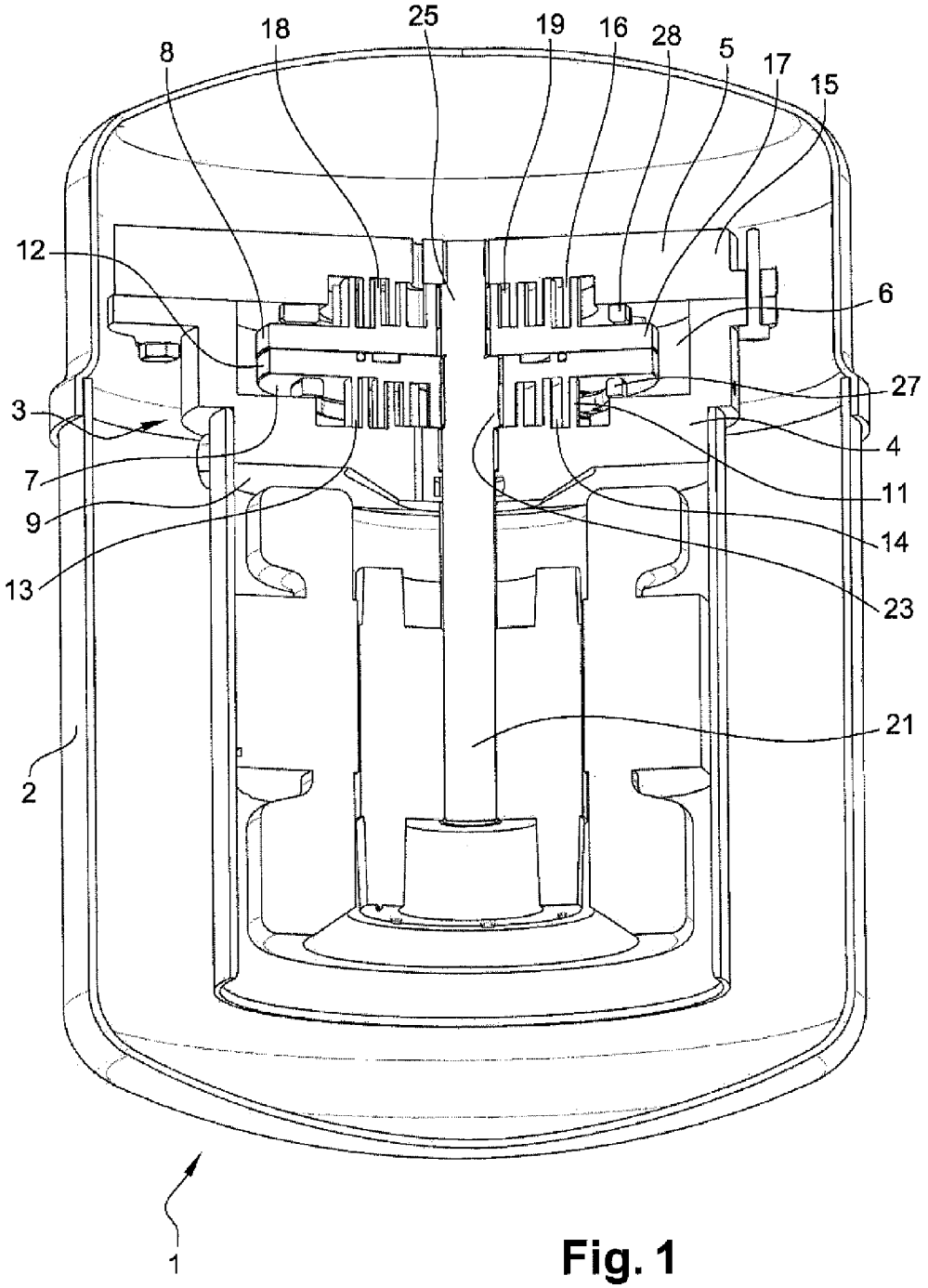
FIG. 1 is a longitudinal section view of a scroll compressor according to the invention.
Figure 2:
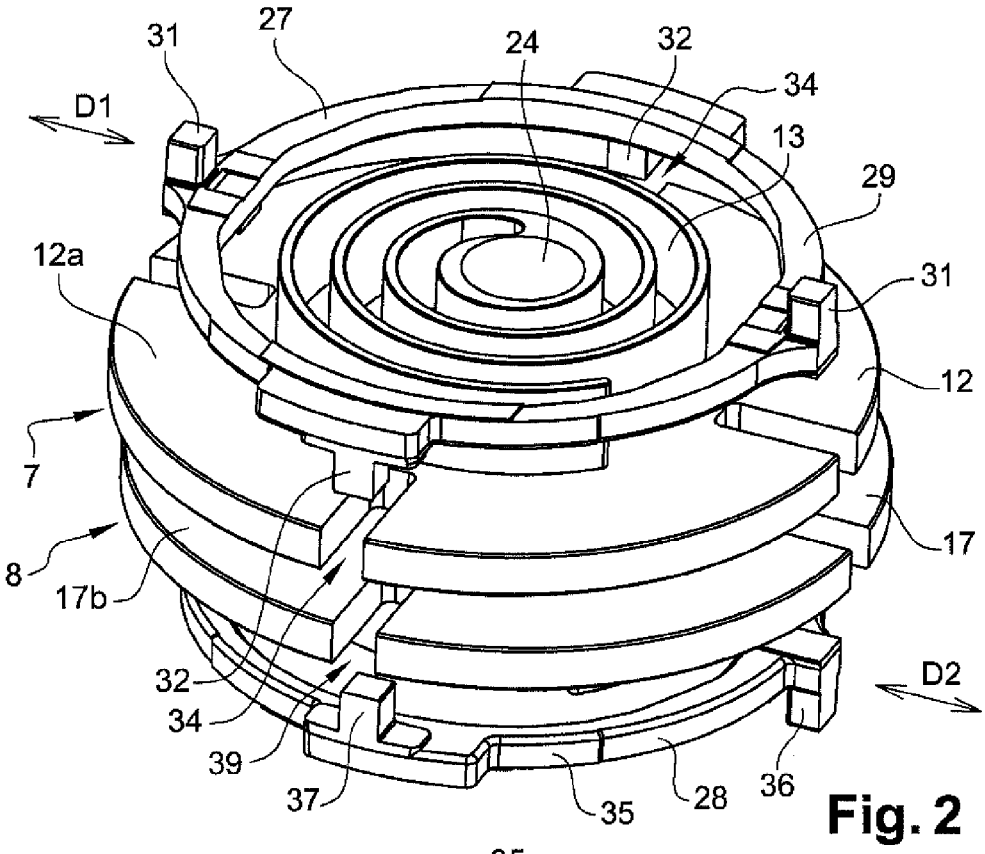
FIGS. 2 and 3 are perspective views respectively from above and below of two Oldham couplings and of two orbiting scroll members of the scroll compressor of FIG. 1.
Figure 3:
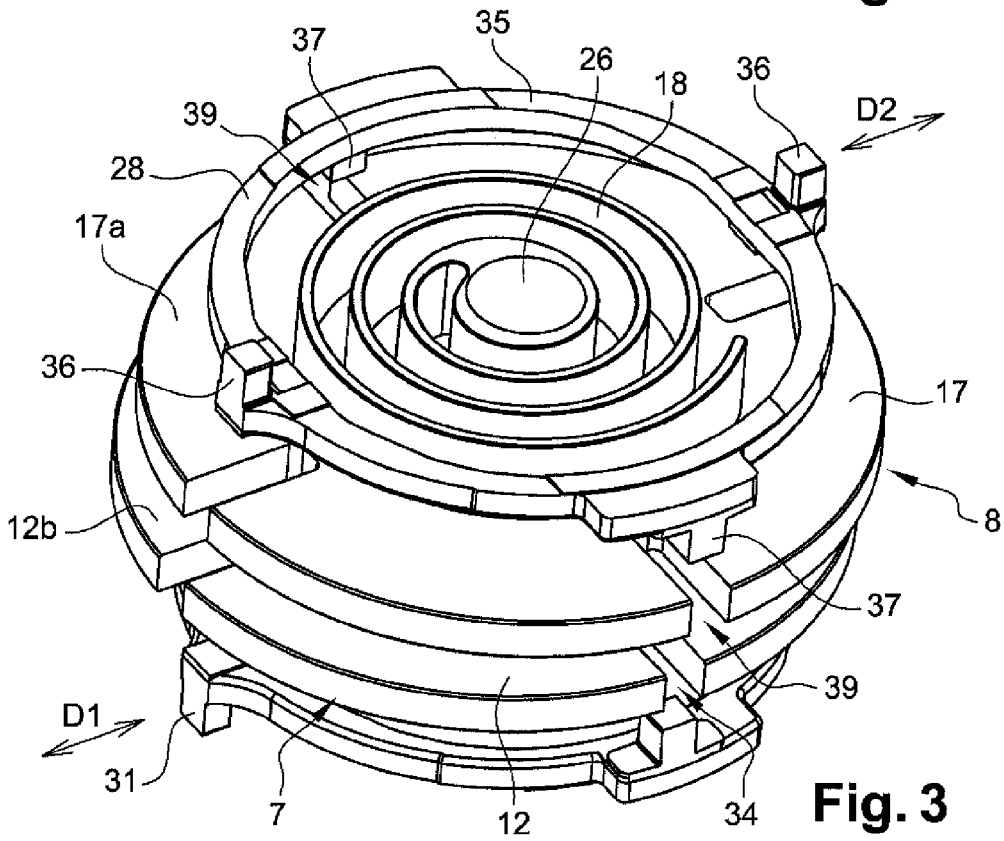
Figures 4A, 4B, 4C, 4D:
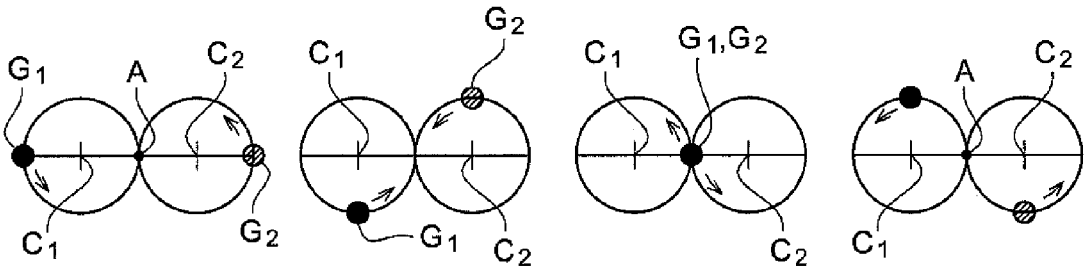
FIGS. 4*a*, 4*b*, 4*c* and 4*d* are schematic views of the two orbiting scroll members of FIG. 2 in several operating positions.

FIG. 1 shows a scroll refrigeration compressor 1 occupying a vertical position. However, the scroll refrigeration compressor 1 according to the invention could occupy an inclined position, or a horizontal position, without significant modification to its structure.

The scroll refrigeration compressor 1 shown in FIG. 1 comprises a closed housing 2 and a scroll compression unit 3 disposed inside the closed housing 2.

The scroll compression unit 3 includes first and second fixed scroll members 4, 5 delimiting an inner volume 6. In particular the first and second fixed scroll members 4, 5 are fixed in relation to the closed housing 2. The first fixed scroll member 4 may for example be secured to the second fixed scroll member 5. The scroll compression unit 3 further includes first and second orbiting scroll members 7, 8 disposed in the inner volume 6.

The first fixed scroll member 4 includes an end plate 9 and a spiral wrap 11 projecting from the end plate 9 towards the first orbiting scroll member 7, and the first orbiting scroll member 7 has an end plate 12 and a spiral wrap 13 projecting from the end plate 12 towards the first fixed scroll member 4. The spiral wrap 13 of the first orbiting scroll member 7 meshes with the spiral wrap 11 of the first fixed scroll member 4 to form a plurality of compression chambers 14 between them. The compression chambers 14 have a variable volume which decreases from the outside towards the inside, when the first orbiting scroll member 7 is driven to orbit relative to the first fixed scroll member 4.

The second fixed scroll member 5 includes an end plate 15 and a spiral wrap 16 projecting from the end plate 15 towards the second orbiting scroll member 8, and the second orbiting scroll member 8 has an end plate 17 and a spiral wrap 18 projecting from the end plate 17 towards the second fixed scroll member 8. The spiral wrap 18 of the second orbiting scroll member 8 meshes with the spiral wrap 16 of the second fixed scroll member 5 to form a plurality of compression chambers 19 between them. The compression chambers 19 have a variable volume which decreases from the outside towards the inside, when the second orbiting scroll member 8 is driven to orbit relative to the second fixed scroll member 5.

The end plate 12 of the first orbiting scroll member 7 includes a first face 12*a* on which is provided the spiral wrap 13, and a second face 12*b* opposite to the first face 12*a*, and the end plate 17 of the second orbiting scroll member 8 includes a first face 17*a* on which is provided the spiral wrap 18, and a second face 17*b* opposite to the first face 17*a*. According to the embodiment shown in the figures, the second faces 12*a*, 17*a* of the first and second end plates 12, 17 face each other. Therefore the spiral wraps 13, 18 project in opposite projection directions.

In particular the second face 12*b* of the end plate 12 of the first orbiting scroll member 7 is in slidable contact with the second face 17*b* of the end plate 17 of the second orbiting scroll member 8.

Furthermore the scroll refrigeration compressor 1 comprises a drive shaft 21 adapted for driving the first and second orbiting scroll members 7, 8 in orbital movements, and an electric motor for driving the drive shaft 21 in rotation about a rotation axis A. The drive shaft 21 comprises a first eccentric pin 23 which is off-centered from the center of the drive shaft 21, and which is inserted in a connecting sleeve 24 of the first orbiting scroll member 7. The drive shaft 21 also comprises a second eccentric pin 25 which is off-centered from the center of the drive shaft 21, and which is inserted in a connecting sleeve 26 of the second orbiting scroll member 8.

FIGS. 4*a* to 4*d* represent particularly the displacements of the centers of gravity G1, G2 of the first and second orbiting scroll members 7, 8 during operation of the scroll refrigeration compressor 1. As shown in FIGS. 4*a* to 4*d*, the first and second orbiting scroll members 7, 8 are configured to operate in phase opposition and to orbit in opposite directions. The orbital diameter of the first orbiting scroll member 7 is equal to the orbital diameter of the second orbiting scroll member 8, and the orbital centers C1, C2 of the first and second orbiting scroll members 7, 8 are offset from each other by a predetermined distance equal to the orbital diameters of the first and second orbiting scroll members 7, 8. Further, the orbital centers C1, C2 of the first and second orbiting scroll members 7, 8 are equally distant from the rotation axis A of the drive shaft 21.

The scroll refrigeration compressor 1 also comprises a first Oldham coupling 27 which is slidably mounted with respect to the first fixed scroll member 4 along a first displacement direction D1, and a second Oldham coupling 28 which is slidably mounted with respect to the second fixed scroll member 5 along a second displacement direction D2 which is parallel to the first displacement direction D1. The first and second displacement directions D1, D2 are substantially perpendicular to the rotation axis A of the drive shaft 21. The first and second Oldham couplings 27, 28 are configured to prevent rotation of the first and second orbiting scroll members 7, 8 with respect to the first and second fixed scroll member 4, 5. Each of the first and second Oldham couplings 27, 28 undergoes a reciprocating translation motion respectively along the first and second displacement directions D1, D2.

The first Oldham coupling 27 includes an annular body 29 disposed between the end plates 9, 12 of the first fixed and orbiting scroll members 4, 7, and around the spiral wraps 11, 13. The first Oldham coupling 27 further includes a pair of first engaging projections 31 provided on a first side of the annular body 29, and a pair of second engaging projections 32 provided on a second side of the annular body 29. The first engaging projections 31 of the first Oldham coupling 27 are slidably engaged in a pair of first guiding grooves (not shown in the figures) provided on the end plate 9 of the first fixed scroll member 4, said first guiding grooves being offset and extending parallel to the first displacement direction D1. The second engaging projections 32 of the first Oldham coupling 27 are slidably engaged in a pair of second guiding grooves 34 provided on the end plate 12 of the first orbiting scroll member 7, the second guiding grooves 34 being offset and extending perpendicularly to the first displacement direction D1.

According to the embodiment of the invention shown in the figures, the first and second engaging projections 31, 32 extend respectively perpendicularly from the first and second sides of the annular body 29.

The second Oldham coupling 28 includes an annular body 35 disposed between the end plates 15, 17 of the second fixed and orbiting scroll members 5, 8. The annular body 35 of the second Oldham coupling 28 extends substantially parallel to the annular body 29 of the first Oldham coupling 27.

The second Oldham coupling 28 further includes a pair of first engaging projections 36 provided on a first side of the annular body 35, and a pair of second engaging projections 37 provided on a second side of the annular body 35. The first engaging projections 36 of the second Oldham coupling 28 are slidably engaged in a pair of first guiding grooves (not shown in the figures) provided on the second fixed scroll member, said first guiding grooves being offset and extending parallel to the second displacement direction D2. The second engaging projections 37 of the second Oldham coupling 28 are slidably engaged in a pair of second guiding grooves 39 provided on the end plate 17 of the second orbiting scroll member 8, the second guiding grooves 39 being offset and extending perpendicularly to the second displacement direction D2. According to the embodiment of the invention shown in the figures, the first and second engaging projections 36, 37 extend respectively perpendicularly from the first and second sides of the annular body 35.

Figures 5A, 5B, 5C:
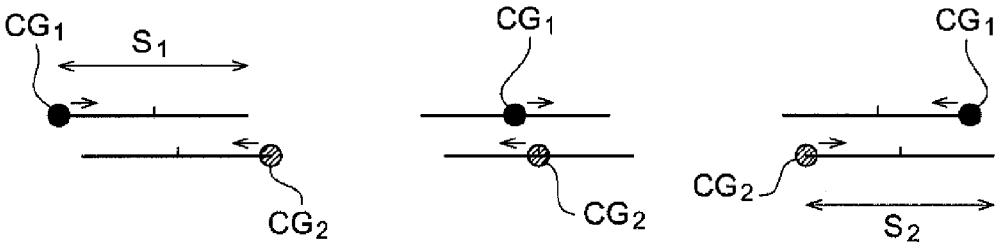
FIGS. 5*a*, 5*b* and 5*c* are schematic views of the two Oldham couplings of FIG. 2 in several operating positions.

As shown in FIGS. 5*a* to 5*c*, the first and second Oldham couplings 27, 28 are configured such that, in operation, the centers of gravity $CG_1$, $CG_2$ of the first and second Oldham couplings 27, 28 are constantly symmetrically located with respect to the rotation axis A of the drive shaft 21. Further, the first and second Oldham couplings 27, 28 are configured such that the middle-stroke positions of the centers of gravity $CG_1$, $CG_2$ of the first and second Oldham couplings 27, 28 are equally distant from the rotation axis A of the drive shaft 21. Furthermore, the stroke length S1 of the first Oldham coupling 27 along the first displacement direction D1 is equal to the stroke length S2 of the second Oldham coupling 28 along the second displacement direction D2.

The scroll refrigeration compressor 1 also includes a refrigerant suction inlet (not shown in the figures) communicating with the inner chamber 6 to achieve the supply of refrigerant to the scroll compression unit 3, and a discharge outlet (not shown in the figures) for discharging the compressed refrigerant outside the scroll refrigeration compressor 1.

Of course, the invention is not restricted to the embodiment described above by way of non-limiting example, but on the contrary it encompasses all embodiments thereof.

The invention claimed is:

1. A scroll compressor comprising:

a first fixed scroll member comprising a first fixed end plate and a first fixed spiral wrap provided on one face of the first fixed end plate, a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a second fixed scroll member comprising a second fixed end plate and a second fixed spiral wrap provided on one face of the second fixed end plate, a second orbiting scroll member comprising a second orbiting end plate and a second orbiting spiral wrap provided on one face of the second orbiting end plate, the second fixed spiral wrap and the second orbiting spiral wrap forming a plurality of second compression chambers, wherein the first and second orbiting scroll members orbit in phase opposition, a first Oldham coupling provided between the first orbiting scroll member and the first fixed scroll member, and preventing rotation of the first orbiting scroll member with respect to the first fixed scroll member, the first Oldham coupling being slidably mounted with respect to the first fixed scroll member along a first displacement direction, and a second Oldham coupling provided between the second orbiting scroll member and the second fixed scroll member, and preventing rotation of the second orbiting scroll member with respect to the second fixed scroll member, the second Oldham coupling being slidably mounted with respect to the second fixed scroll member along a second displacement direction, wherein the first and second displacement directions of the first and second Oldham couplings are substantially parallel with respect to each other.

2. The scroll compressor according to claim 1, wherein an orbital diameter of the first orbiting scroll member is substantially equal to an orbital diameter of the second orbiting scroll member.

3. The scroll compressor according to claim 2, wherein orbital centers of the first and second orbiting scroll members are offset from each other by a predetermined distance substantially equal to the orbital diameters of the first and second orbiting scroll members.

4. The scroll compressor according to claim 1, wherein the stroke length of the first Oldham coupling along the first displacement direction is substantially equal to the stroke length of the second Oldham coupling along the second displacement direction.

5. The scroll compressor according to claim 1, wherein the first Oldham coupling includes:

a first annular body, a first pair of first engaging projections provided on a first side of the first annular body, the first engaging projections of the first Oldham coupling being slidably engaged in a first pair of first guiding grooves provided on the first fixed scroll member, said first guiding grooves being offset and extending substantially parallel to the first displacement direction, and a second pair of second engaging projections provided on a second side of the first annular body, the second engaging projections of the first Oldham coupling being slidably engaged in a second pair of second guiding grooves provided on the first orbiting scroll member, said second guiding grooves being offset and extending substantially perpendicularly to the first displacement direction.

6. The scroll compressor according to claim 1, wherein the second Oldham coupling includes:

a second annular body, a first pair of first engaging projections provided on a first side of the second annular body, the first engaging projections of the second Oldham coupling being slidably engaged in a first pair of first guiding grooves provided on the second fixed scroll member, said first guiding grooves being offset and extending substantially parallel to the second displacement direction, and a second pair of second engaging projections provided on a second side of the second annular body, the second engaging projections of the second Oldham coupling being slidably engaged in a second pair of second guiding grooves provided on the second orbiting scroll member, said second guiding grooves being offset and extending substantially perpendicularly to the second displacement direction.

7. The scroll compressor according to claim 1, further comprising a drive shaft adapted for driving the first and second orbiting scroll members in orbital movements, the drive shaft having rotation axis.

8. The scroll compressor according to claim 7, wherein orbital centers of the first and second orbiting scroll members are equally distant from the rotation axis of the drive shaft.

9. The scroll compressor according to claim 1, further comprising a drive shaft adapted for driving the first and second orbiting scroll members in orbital movements, the drive shaft having rotation axis, wherein in operation, centers of gravity of the first and second Oldham couplings are constantly symmetrically located with respect to the rotation axis of the drive shaft.

10. The scroll compressor according to claim 1, wherein the first orbiting spiral wrap projects in a first projection direction, and the second orbiting spiral wrap projects in a second projection direction opposite to the first projection direction.

11. The scroll compressor according to claim 1, wherein:

the first orbiting end plate includes a first face on which is provided the first orbiting spiral wrap, and a second face opposite to the first face of the first orbiting end plate, and the second orbiting end plate includes a first face on which is provided the second orbiting spiral wrap, and a second face opposite to the first face of the second orbiting end plate, the second faces of the first and second orbiting end plates facing each other.

12. A method of operating a scroll compressor, comprising the steps of:

providing the scroll compressor with:

a first fixed scroll member comprising a first fixed end plate and a first fixed spiral wrap provided on one face of the first fixed end plate, a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a second fixed scroll member comprising a second fixed end plate and a second fixed spiral wrap provided on one face of the second fixed end plate, a second orbiting scroll member comprising a second orbiting end plate and a second orbiting spiral wrap provided on one face of the second orbiting end plate, the second fixed spiral wrap and the second orbiting spiral wrap forming a plurality of second compression chambers, a first Oldham coupling provided between the first orbiting scroll member and the first fixed scroll member, and preventing rotation of the first orbiting scroll member with respect to the first fixed scroll member, the first Oldham coupling being slidably mounted with respect to the first fixed scroll member along a first displacement direction, and a second Oldham coupling provided between the second orbiting scroll member and the second fixed scroll member, and preventing rotation of the second orbiting scroll member with respect to the second fixed scroll member, the second Oldham coupling being slidably mounted with respect to the second fixed scroll member along a second displacement direction, wherein the first and second displacement directions of the first and second Oldham couplings are substantially parallel with respect to each other, and displacing the first and second orbiting scroll members respectively along first and second orbital movements in phase opposition so that the inertia force induced by the orbiting movement of the first orbiting scroll member is at least partially compensated by the inertia force induced by the orbiting movement of the second orbiting scroll member.

13. A scroll compressor comprising:

a first fixed scroll member comprising a first fixed end plate and a first fixed spiral wrap provided on one face of the first fixed end plate, a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a second fixed scroll member comprising a second fixed end plate and a second fixed spiral wrap provided on one face of the second fixed end plate, a second orbiting scroll member comprising a second orbiting end plate and a second orbiting spiral wrap provided on one face of the second orbiting end plate, the second fixed spiral wrap and the second orbiting spiral wrap forming a plurality of second compression chambers, wherein the first and second orbiting scroll members are displaceable in phase opposition respectively along first and second orbital movements, a first Oldham coupling provided between the first orbiting scroll member and the first fixed scroll member, and preventing rotation of the first orbiting scroll member with respect to the first fixed scroll member, the first Oldham coupling being slidably mounted with respect to the first fixed scroll member along a first displacement direction, and a second Oldham coupling provided between the second orbiting scroll member and the second fixed scroll member, and preventing rotation of the second orbiting scroll member with respect to the second fixed scroll member, the second Oldham coupling being slidably mounted with respect to the second fixed scroll member along a second displacement direction, wherein the first and second displacement directions of the first and second Oldham couplings are substantially parallel with respect to each other.

* * * * *